US010893600B2

(12) United States Patent
Boulos et al.

(10) Patent No.: US 10,893,600 B2
(45) Date of Patent: Jan. 12, 2021

(54) HIGH PERFORMANCE INDUCTION PLASMA TORCH

(71) Applicant: TEKNA PLASMA SYSTEMS INC., Sherbrooke (CA)

(72) Inventors: Maher I. Boulos, Sherbrooke (CA); Nicolas Dignard, Sherbrooke (CA); Alexandre Auger, Sherbrooke (CA); Jerzy Jurewicz, Sherbrooke (CA); Sebastien Thellend, Sherbrooke (CA)

(73) Assignee: TEKNA PLASMA SYSTEMS INC.

( * ) Notice: Subject to any disclaimer, the term of this patent is extended or adjusted under 35 U.S.C. 154(b) by 786 days.

(21) Appl. No.: 15/178,068

(22) Filed: Jun. 9, 2016

(65) Prior Publication Data

US 2016/0323987 A1 Nov. 3, 2016

Related U.S. Application Data

(62) Division of application No. 13/498,736, filed as application No. PCT/CA2012/000094 on Feb. 2, 2012, now Pat. No. 9,380,693.

(Continued)

(51) Int. Cl.

| | |
|---|---|
| ***H05H 1/30*** | (2006.01) |
| ***H05H 1/28*** | (2006.01) |
| ***H05H 1/26*** | (2006.01) |

(52) U.S. Cl.

CPC ..... *H05H 1/30* (2013.01); *H05H 1/26* (2013.01); *H05H 1/28* (2013.01)

(58) Field of Classification Search

CPC .. H05H 1/26; H05H 1/28; H05H 1/30; H05H 1/34; H05H 2001/3457

(Continued)

(56) References Cited

U.S. PATENT DOCUMENTS

| | | | |
|---|---|---|---|
| 4,897,579 | A | 1/1990 | Hull |
| 5,200,595 | A | 4/1993 | Boulos et al. |

(Continued)

FOREIGN PATENT DOCUMENTS

| | | | |
|---|---|---|---|
| CA | 2244749 | A1 | 8/1997 |
| CN | 1189859 | A | 8/1998 |

(Continued)

OTHER PUBLICATIONS

Written Opinion of the International Search Report—(PCT/CA2012/000094), Date of completion May 23, 2012, 5 pages.

(Continued)

*Primary Examiner* — Dana Ross
*Assistant Examiner* — Joseph W Iskra
(74) *Attorney, Agent, or Firm* — K&L Gates LLP

(57) ABSTRACT

An induction plasma torch comprises a tubular torch body, a plasma confinement tube disposed in the tubular torch body coaxial therewith, a gas distributor head disposed at one end of the plasma confinement tube and structured to supply at least one gaseous substance into the plasma confinement tube; an inductive coupling member embedded within the tubular torch body for applying energy to the gaseous substance to produce and sustain plasma in the plasma confinement tube, and an electrically conductive capacitive shield on an inner surface of the tubular torch body. The capacitive shield is segmented into axial strips interconnected at one end. Axial grooves are machined in the inner surface of the tubular torch body, the axial grooves being interposed between the axial strips.

20 Claims, 8 Drawing Sheets

Related U.S. Application Data

(60) Provisional application No. 61/439,161, filed on Feb. 3, 2011.

(58) Field of Classification Search
USPC ..... 219/121.36, 121.48, 121.49, 121.52; 204/192.12, 192.17; 156/345.3, 345.48
See application file for complete search history.

(56) References Cited

U.S. PATENT DOCUMENTS

| | | | | |
|---|---|---|---|---|
| 5,233,155 | A * | 8/1993 | Frind | H05H 1/46 219/121.36 |
| 5,234,529 | A | 8/1993 | Johnson | |
| 5,360,941 | A | 11/1994 | Roes | |
| 5,534,231 | A | 7/1996 | Savas | |
| 5,560,844 | A | 10/1996 | Boulos et al. | |
| 5,877,471 | A * | 3/1999 | Huhn | H05H 1/28 219/121.43 |
| 6,248,251 | B1 | 6/2001 | Sill | |
| 6,312,555 | B1 | 11/2001 | Daviet | |
| 6,385,977 | B1 | 5/2002 | Johnson | |
| 6,693,253 | B2 | 2/2004 | Boulos et al. | |
| 6,919,527 | B2 | 7/2005 | Boulos et al. | |
| 7,578,946 | B2 | 8/2009 | Ikeda | |
| 2003/0080097 | A1 | 5/2003 | Boulos et al. | |
| 2005/0194099 | A1 | 9/2005 | Jewett, Jr. et al. | |

FOREIGN PATENT DOCUMENTS

| | | | |
|---|---|---|---|
| CN | 1316021 | A | 10/2001 |
| CN | 1554114 | A | 12/2004 |
| EP | 801413 | A1 | 10/1997 |
| EP | 2341525 | A2 | 7/2011 |
| JP | H01-140600 | A | 6/1989 |
| JP | 5-508053 | A | 11/1993 |
| JP | 6-342640 | A | 12/1994 |
| JP | 09-129397 | | 5/1997 |
| JP | 10-284299 | A | 10/1998 |
| JP | 2000-182799 | | 6/2000 |
| JP | 2004-160338 | A | 6/2004 |
| JP | 2009-21492 | A | 1/2009 |
| KR | 10-0793154 | B1 | 1/2008 |
| KR | 10-2009-0112360 | A | 10/2009 |
| WO | 92/19086 | A1 | 10/1992 |
| WO | 96/15545 | A1 | 5/1996 |

OTHER PUBLICATIONS

D'Agostino et al., "Advanced plasma technology," Wiley-VCH, Dec. 31, 2008, pp. 1-482.

Translation of First Office Action for Chinese Patent Application No. 201710063927.3, dated Sep. 30, 2018, 11 pages.

* cited by examiner

HIGH PERFORMANCE INDUCTION PLASMA TORCH

CROSS REFERENCE TO RELATED APPLICATIONS

This application is a divisional of U.S. patent application Ser. No. 13/498,736 filed on Jun. 21, 2012, which claims priority to a national phase application under 35 U.S.C. § 371 of International Application No. PCT/CA2012/000094, filed on Feb. 2, 2012, which claims priority to and the benefit of U.S. Provisional Patent Application No. 61/439,161 filed on Feb. 3, 2011, the entire disclosures of each of which are incorporated by reference herein.

FIELD

The present disclosure generally relates to induction plasma torches. More specifically but not exclusively, the present disclosure relates to a plasma confinement tube and a tubular torch body comprising a capacitive shield and an induction plasma torch comprising such plasma confinement tube and tubular torch body for operation under ultra high purity and high power density conditions at laboratory and industrial scale production conditions.

BACKGROUND

Induction plasma torches have attracted increasing attention as a valuable tool for materials synthesis and processing under high temperature plasma conditions. The basic concept has been known for more than sixty years and has evolved steadily form a laboratory tool to an industrially worthy high power device. Operation of an induction plasma torch involves an electromagnetic coupling of energy into the plasma using an inductive coupling member, for example a 4-6 turns induction coil. A gas distributor head is used to create a proper gaseous flow pattern into the discharge region where plasma is generated. This gaseous flow pattern not only stabilizes the plasma at the center of a plasma confinement tube made, for example of quartz, but also maintains the plasma in the center of the induction coil and protects the plasma confinement tube against damage due to the high heat load from the plasma. At relatively high power levels (above 5-10 kW), additional cooling is required to protect the plasma confinement tube. This is usually achieved using a cooling fluid, for example deionized cooling water flowing on the outer surface of the plasma confinement tube.

A standard design of induction plasma torch is illustrated in FIG. 1. the plasma torch of FIG. 1 comprises a cylindrical enclosure surrounded by a water-cooled induction copper coil supplied with a high frequency current. Plasma gas is introduced axially into the inner space of the cylindrical enclosure. As the electrical current flows though the induction coil it creates an axial alternating magnetic field responsible for an electrical breakdown of the plasma gas in the discharge cavity. Once breakdown is achieved a tangential induced current is developed into the plasma gas within the induction coil region. This tangential induced current heats the plasma gas in the discharge cavity to ignite, produce and sustain plasma.

Numerous designs have been developed and experimented to construct induction plasma torches based on essentially the same principles. Various improvements in induction plasma torches are also taught in U.S. Pat. No. 5,200,595 issued on Apr. 6, 1993 and entitled High Performance Induction Plasma Torch with a Water-Cooled Ceramic Confinement Tube; U.S. patent application Ser. No. 08/693,513 (Aug. 4, 1995) entitled Ignition Device and Method for Igniting a Plasma Discharge in an Induction Plasma Torch; U.S. Pat. No. 5,560,844 issued on Oct. 1, 1996 and entitled Liquid Film Stabilized Induction Plasma Torch; U.S. Pat. No. 6,693,253 issued on Feb. 17, 2004 and entitled Multi-coil induction plasma torch for solid state power supply; and U.S. Pat. No. 6,919,527 issued on Jul. 19, 2005 and entitled Multi-coil induction plasma torch for solid state power supply, the full subject matters thereof being incorporated herein by reference.

Attempts have also been made to improve the protection of the plasma confinement tube. For example, a segmented metallic wall insert has been used to improve protection of the plasma confinement tube but presents the drawback of substantially reducing the overall energy efficiency of the plasma torch. Also, a plasma confinement tube made of porous ceramic material offers only limited protection. Concerning confinement tubes cooled by radiation, their ceramic materials must withstand relatively high operating temperatures, exhibit an excellent thermal shock resistance and must not absorb the RF (Radio Frequency) magnetic field. Most ceramic materials fail to meet with one or more of these stringent requirements.

A continuing concern with current induction plasma torches is the problem of arcing between the plasma and the exit nozzle of the torch and/or the body of the reactor on which the torch is mounted. A schematic representation of the problem of strike-over is illustrated for both cases in FIG. 2.

More specifically, FIG. 2 illustrates an induction plasma torch including a tubular torch body including a plasma confinement tube for producing plasma. An induction coil is embedded in the tubular torch body. Any powder materials or precursor to be processed in the plasma is injected via a powder injector probe mounted axially through a gas distributor head that sits on top of the plasma torch body. A plasma discharge is produced into a reactor defined by a reactor wall via a water-cooled nozzle. FIG. 2 shows arcing (strike over) between the plasma and the exit nozzle of the torch and the body of the reactor.

An early attempt for solving the problem of arcing in an induction plasma torch was reported by G. Frind in 1991 and was the subject of U.S. Pat. No. 5,233,155 issued on Aug. 3, 1993. This patent identified that arcing was due to capacitive coupling between the induction coil and the plasma and proposed a solution through the addition of a capacitive shield between the induction coil and the outer surface of the plasma confinement tube. Yet, the introduction of the capacitive shield as proposed by Frind resulted in an increased difficulty of plasma ignition and significant loss of energy coupling efficiency between the coil and the plasma due to energy dissipation in the metallic shield.

There thus remains a need for eliminating arcing without losing energy coupling efficiency and increasing the power/energy density into the plasma discharge cavity.

SUMMARY

In accordance with a first aspect, the present disclosure relates to a tubular torch body for use in an induction plasma torch, the tubular torch body comprising an inductive coupling member embedded therein, defining a geometrical axis and an inner surface, and comprising a conductive capacitive shield on the inner surface of the tubular torch body and segmented into axial strips. The axial strips are interconnected at one end.

Another aspect is concerned with a tubular torch body for use in an induction plasma torch. The tubular torch body comprises an inductive coupling member embedded therein, defines a geometrical axis and an inner surface, and includes a conductive capacitive shield and axial grooves. The conductive capacitive shield is placed on the inner surface of the tubular torch body and segmented into axial strips interconnected at one end. The axial grooves are made in the inner surface of the tubular torch body through a material of the tubular torch body. The axial grooves are interposed between the axial strips.

The present disclosure also relates, in accordance with a third aspect, to an induction plasma torch comprising: a tubular torch body having an inner surface; a plasma confinement tube disposed in the tubular torch body coaxial with this tubular torch body; a gas distributor head disposed at one end of the plasma confinement tube and structured to supply at least one gaseous substance into the plasma confinement tube; an inductive coupling member embedded within the tubular torch body for applying energy to the gaseous substance to produce and sustain plasma in the plasma confinement tube; and a conductive capacitive shield on the inner surface of the tubular torch body, wherein the capacitive shield is segmented into axial strips, and the axial strips are interconnected at one end.

A fourth aspect is concerned with an induction plasma torch comprising: a tubular torch body having an inner surface; a plasma confinement tube disposed in the tubular torch body coaxial with said tubular torch body; a gas distributor head disposed at one end of the plasma confinement tube and structured to supply at least one gaseous substance into the plasma confinement tube; an inductive coupling member embedded within the tubular torch body for applying energy to the gaseous substance to produce and sustain plasma in the plasma confinement tube; an electrically conductive capacitive shield on the inner surface of the tubular torch body, wherein the capacitive shield is segmented into axial strips and the axial strips are interconnected at one end; and axial grooves in the inner surface of the tubular torch body through a material of the tubular torch body, the axial grooves being interposed between the axial strips.

The foregoing and other features will become more apparent upon reading of the following non-restrictive description of illustrative embodiments, given by way of example only with reference to the accompanying drawings.

DETAILED DESCRIPTION

Generally stated the present disclosure provides an induction plasma torch that comprises a tubular torch body, a plasma confinement tube, a gas distributor head, an inductive coupling member and a capacitive shield coupled to the plasma confinement tube or the tubular torch body. Plasma is produced in the confinement tube. The plasma confinement tube includes inner and outer surfaces and first and second ends. A series of laterally adjacent axial grooves may be machined in the outer surface of the plasma confinement tube around its perimeter at the level of the inductive coupling member in order to improve cooling of the plasma confinement tube. The gas distributor head is disposed at the first end of the plasma confinement tube for supplying at least one gaseous substance into this confinement tube, the gaseous substance(s) flowing through the confinement tube from its first end toward its second end. The inductive coupling member inductively applies energy to the gaseous substance flowing through the confinement tube in order to inductively ignite, produce and sustain plasma in this tube. The capacitive shield avoids arcing without loss in energy coupling efficiency and allows for an increase of the power/energy density into the confinement tube where plasma discharge is produced. This capacitive shield may be formed, according to one embodiment, of a conductive thin film.

Figure 3:
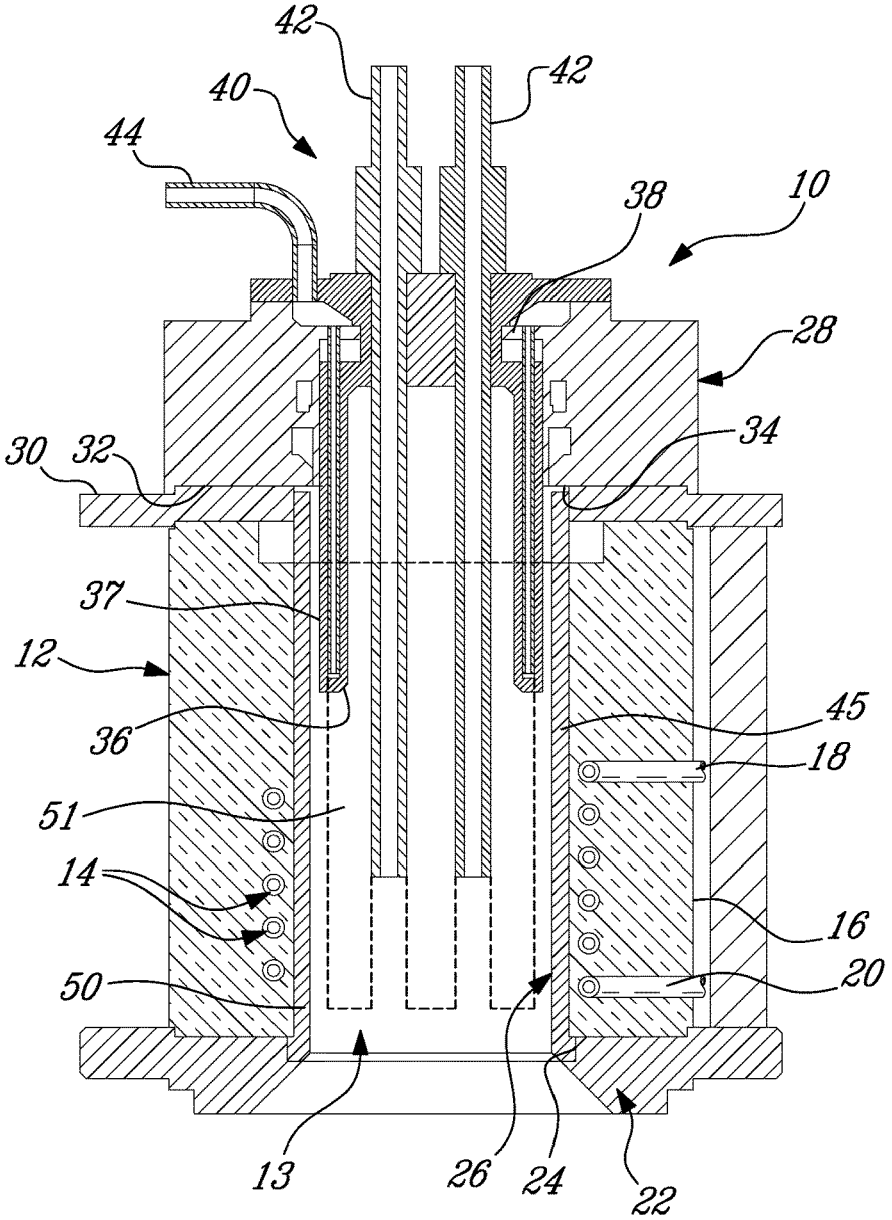
FIG. 3 is a schematic elevation, cross sectional representation of an induction plasma torch with multiple powder injection probes and with a capacitive shield on an outer surface of a plasma confinement tube.

FIG. 3 illustrates a high performance induction plasma torch 10.

The plasma torch 10 comprises a tubular torch body 12 made of, for example, a cast ceramic or composite polymer and defining an inner cavity 13. An inductive coupling member in the form of an induction coil 14, made of a water-cooled copper tube, is embedded within the torch body 12. The two ends of the induction coil 14 both extend to the outer surface 16 of the cylindrical torch body 12 and are respectively connected to a pair of electric terminals 18 and 20 through which an RF (Radio Frequency) current can be supplied to the coil 14. The torch body 12 and the induction coil 14 are, in the illustrated embodiment, both cylindrical and coaxial.

An annular plasma exit nozzle 22 is mounted to a lower end of the torch body 12 and is formed with an annular seat 24 to receive a lower end of a plasma confinement tube 26. As illustrated in FIG. 3, the annular seat 24 may have a right-angle cross section.

A gas distributor head 28 is secured to an upper end of the tubular torch body 12. A disk 30 is interposed between the upper end of the torch body 12 and the gas distributor head 28. The disk 30 forms with the underside 32 of the gas distributor head 28 an annular seat 34 capable of receiving an upper end of the plasma confinement tube 26. Again, the annular seat 34 has a right-angle cross section, as illustrated in FIG. 3.

In the embodiment illustrated in FIG. 3, the tubular torch body 12 and the plasma confinement tube 26 are coaxial and define a common geometrical axis.

The gas distributor head 28 also comprises an intermediate tube 36. The intermediate tube 36 is shorter and smaller in diameter than the plasma confinement tube 26. Intermediate tube 36 may also be cylindrical and coaxial with the torch body 12, the plasma confinement tube 26 and the induction coil 14. A cylindrical cavity 37 is accordingly defined between the intermediate tube 36 and the plasma confinement tube 26.

Figure 4:
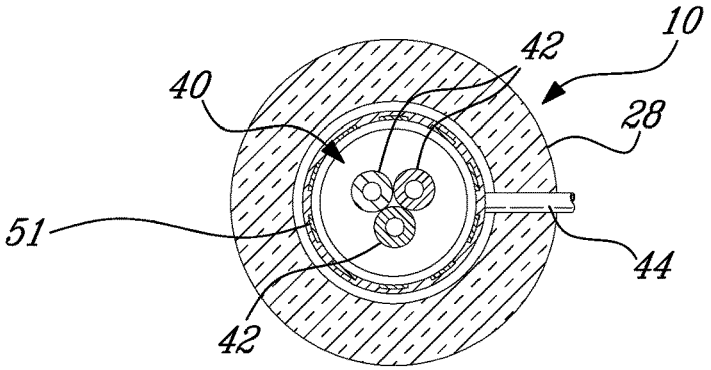
FIG. 4 is a top plan view of the induction plasma torch of FIG. 3.

The gas distributor head 28 is provided with a central opening 38 through which a powder injection probe structure 40 is mounted (see also FIG. 4). The injection probe structure 40 includes at least one powder injection probe (42' in the embodiment of FIG. 5) coaxial with the tubes 26 and 36, the induction coil 14 and the torch body 12. According to another embodiment, FIGS. 3 and 4 show three (3) powder injection probes 42 which are elongated and centrally grouped (see FIG. 4) along the common geometrical axis of the tubes 26 and 36, within theses tubes 26 and 36.

Powder and a carrier gas are injected in the plasma torch 10 through the probe(s) 42, 42'. The powder transported by the carrier gas and injected into the plasma confinement tube 26 constitutes a material to be molten or vaporized by the plasma, as known in the art.

The gas distributor head 28 comprises a conduit (not shown) suitable to inject a sheath gas in the cylindrical cavity 37 and to cause a longitudinal flow of this sheath gas over the inner surface of the plasma confinement tube 26. The gas distributor head 28 also comprises a conduit 44 to inject a central gas inside the intermediate tube 36 and to cause a tangential flow of this central gas. The function of these sheath and central gases is well known in the art of induction plasma torches and accordingly will not be described in the present description.

A thin annular chamber 45, for example about 1 mm thick, is formed between the outer surface of the plasma confinement tube 26 and an inner surface of the tubular torch body 12. More specifically, the annular chamber 45 is made by machining to low tolerance the said outer surface of the plasma confinement tube 26 and inner surface of the tubular torch body 12. A cooling fluid, for example de-ionized cooling water, is supplied to the thin annular chamber 45 and flows through the chamber 45 at high velocity to efficiently cool the plasma confinement tube 26 of which the inner surface is exposed to the high temperature of the plasma. More specifically, the cooling fluid can be supplied via an inlet (not shown) in the gas distributor head 28 to flow through a series of cylindrical channels (not shown) in the torch body 12 reaching the exit nozzle 22 to efficiently cool the inner surface of this exit nozzle 22 which is exposed to the heat produced by the plasma. The cooling fluid then flows upward at high velocity through the thin annular chamber 45 and within the above-mentioned axial grooves machined in the outer surface of the plasma confinement tube 26 thus effectively cooling the plasma confinement tube 26 of which the inner surface is directly exposed to the intense heat from the plasma, before finally exiting the torch at the level of the gas distributor head 28.

In operation, an inductively coupled plasma is ignited, produced and sustained by supplying an RF current to the induction coil 14 to produce an RF magnetic field within the plasma confinement tube 26. The RF magnetic field induces Eddy currents in the ionized gas substance in the plasma confinement tube 26 and through Joule heating, a stable plasma is ignited, produced and sustained. Operation of an induction plasma torch, including ignition of the plasma, is believed to be well known to those of ordinary skill in the art and, for that reason, will not be further described in the present description.

The plasma confinement tube 26 may be made of ceramic material, either pure or composite ceramic material based for example on sintered or reaction bonded silicon nitride, boron nitride, aluminum nitride and alumina, or any combinations thereof with varying additives and fillers. This ceramic material is dense and characterized by a high thermal conductivity, a high electrical resistivity and a high thermal shock resistance.

As the material of the plasma confinement tube 26 presents a high thermal conductivity, the high velocity of the cooling fluid flowing through the annular chamber 45 provides a high heat transfer coefficient suitable and required to properly cool the plasma confinement tube 26. The addition of the above mentioned series of laterally adjacent axial grooves in the outer surface of the plasma confinement tube 26, as will be described in more detail hereinafter with reference to FIGS. 6, 7 and 8, enhances the cooling of the plasma confinement tube 26 through the increase of the available heat transfer surface, and by reducing the effective thickness of the wall of the tube 26 at the bottom of the grooves. The intense and efficient cooling of the outer surface of the plasma confinement tube 26 enables production of plasma at much higher power density and at lower gas flow rates than normally required in standard plasma torches comprising a confinement tube made of quartz. This causes in turn higher specific enthalpy levels of the gases at the exit of the plasma torch.

Figure 5:
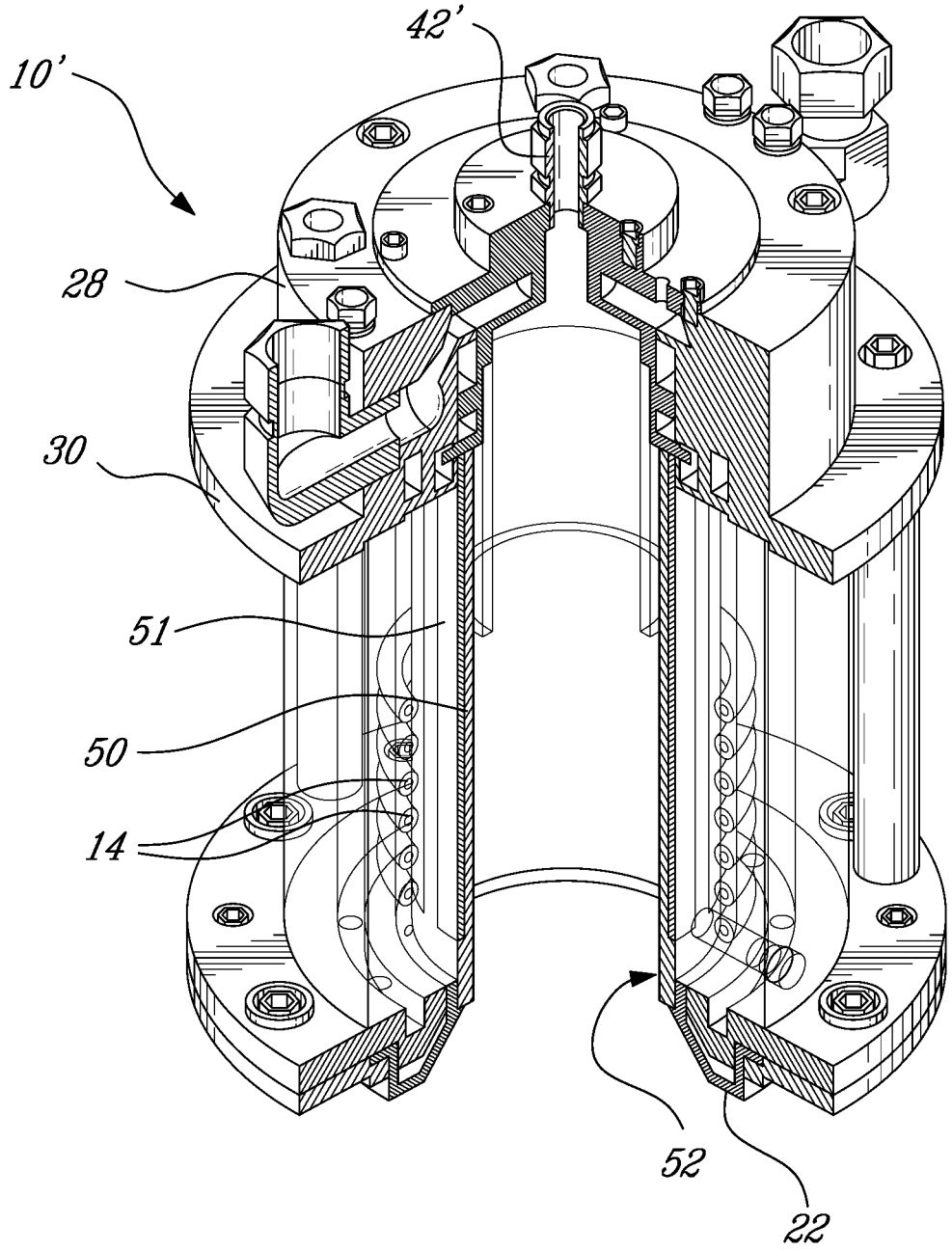
FIG. 5 is schematic partial and perspective representation of another induction plasma torch with a capacitive shield on the outer surface of the plasma confinement tube.

FIG. 5 shows a plasma torch 10' similar to the plasma torch 10 of FIGS. 3 and 4, as mentioned above with the difference that the plasma torch 10' includes only one central powder injection probe 42' and as such needs not be described further as all other elements are similar to plasma torch 10.

A capacitive shield 50 is applied to the outer surface of the plasma confinement tube 26.

The capacitive shield 50 may be applied, for example, through deposition of a thin film of conductive material coating the outer surface of the plasma confinement tube 26. The conductive material can be metallic material such as copper, nickel, gold or platinum or other metals. The thickness of the film is smaller than the skin-depth calculated for the frequency of the applied RF magnetic field and the electrical conductivity of the conductive material of the film, in order to reduce magnetic coupling energy losses caused by the capacitive shield 50, and as a consequence will provide a corresponding increase in torch efficiency. In general, the thickness of the film will be equal to or lower than 100 microns. In one embodiment, the thickness of the film is situated in the range from about 100 micron to about 10 microns. In another embodiment, the film thickness is in the range from 10 micron to 1 micron. In a further embodiment, the film thickness is smaller than 1 micron.

The skin-depth may be defined as follows. Skin effect is the tendency of an alternating electric current to distribute itself within a conductor with the current density being largest near the surface of the conductor, decreasing at greater depths. The electric current flows mainly at the "skin" of the conductor, between the outer surface and a level called the skin-depth. The skin effect causes the effective resistance of the conductor to increase at higher frequencies where the skin-depth is smaller, thus reducing the effective cross-section of the conductor.

$$\text{Skin depth } \delta = \frac{1}{\sqrt{\pi \xi_0 \sigma f}}$$

where;

$\xi_0$=Magnetic permeability of free space=$4\pi\times10^{-7}$ (H/m) or (V·s/A·m)

$\sigma$=Electrical conductivity of the capacitive shield material (mho/m) or (A/V·m)

$f$=Oscillator frequency ($s^{-1}$)

Deposition of the capacitive shield 50 on the outer surface of the plasma confinement tube 26 in direct contact with the torch cooling fluid flowing through the annular chamber 45 ensures efficient cooling of the capacitive shield 50 and protection of its long-term mechanical integrity.

As illustrated in FIGS. 3-5, to avoid as much as possible electromagnetic coupling in the film of conductive material forming the capacitive shield 50, the film is segmented by forming multiple narrow and laterally adjacent axial strips 51. The strips 51 axially extend on the outer surface of the plasma confinement tube 26 over most of the length of the tube 26, with equal inter-distance between each pair of adjacent axial strips 51. All the axial strips 51 are electrically interconnected at one end, more specifically at the upper end of the plasma confinement tube 26.

To facilitate ignition of the plasma, means may be provided for maintaining the capacitive shield 50 at a floating electric potential until plasma ignition is achieved. When plasma has been ignited, is produced and is sustained, means are provided for connecting the capacitive shield 50 to the ground at its upper end where all the axial strips 51 are interconnected in order to drain any capacitive potential developed on the surface of the film forming the capacitive shield 50.

Figure 6:
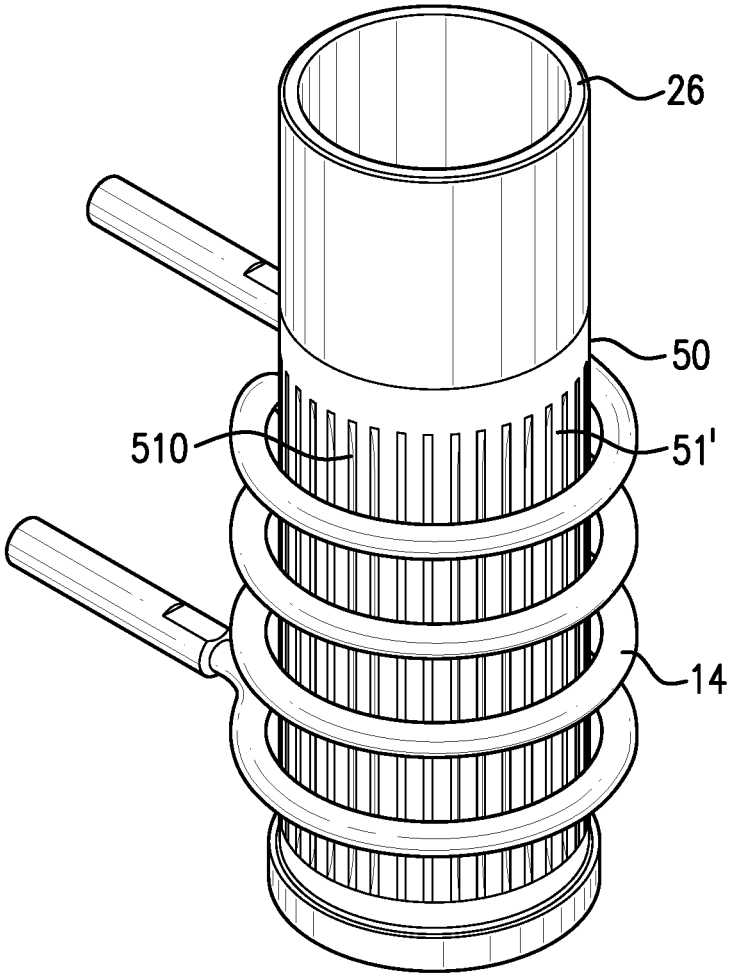
FIG. 6 is a schematic representation of a plasma confinement tube having an outer surface comprising a segmented film conductive capacitive shield and formed with axial grooves machined in the outer surface of the plasma confinement tube at the level of an induction coil.
Figure 7:
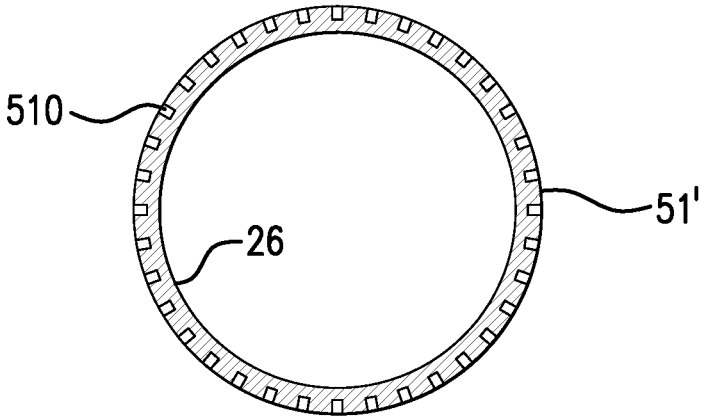
FIG. 7 is a cross section view of the plasma confinement tube of FIG. 6, showing a typical distribution of the grooves around an outer perimeter of the plasma confinement tube.
Figure 8:
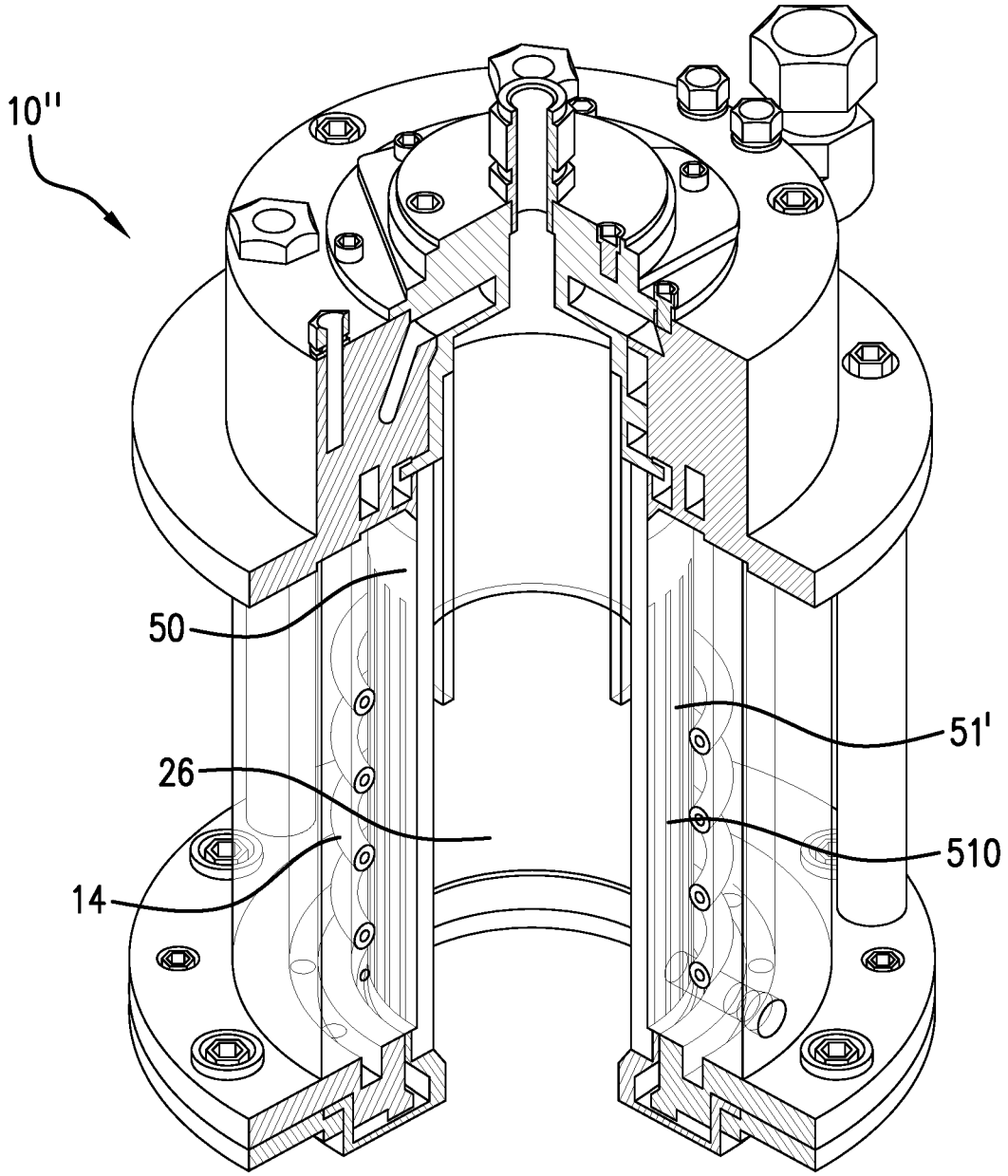
FIG. 8 is a schematic perspective view of an induction plasma torch comprising the plasma confinement tube of FIGS. 6 and 7.

In another embodiment in which the film of conductive material forming the capacitive shield 50 is formed with multiple, laterally adjacent axial strips 51' with equal inter-distance between each pair of laterally adjacent strips 51', the outer surface of the plasma confinement tube 26 is machined to form the above mentioned axial grooves, referenced 510, interposed between the axial strips 51'. More specifically, one of the axial grooves occupies the space between each pair of laterally adjacent axial strips 51'. In this embodiment as illustrated in FIGS. 6 and 7, the axial grooves 510 are not covered by the conductive film, and the axial strips 51' and the axial grooves 510 are disposed longitudinally on the outer surface of the plasma confinement tube 26 at the level of the induction coil 14. All of the axial strips 51' are electrically interconnected at the upper end of the tube 26. A plasma torch 10" comprising a plasma confinement tube 26 with axial strips 51' and axial grooves 510 is illustrated in FIG. 8.

Segmentation of the film of conductive material forming the capacitive shield 50 into axial strips 51 or 51' along most of the length of the outer surface of the plasma confinement tube 26 or at the level of the induction coil 14 will also significantly improve coupling of the RF magnetic field produced by the induction coil 14 with the plasma in the plasma confinement tube 26 and will also significantly reduce magnetic coupling energy losses caused by the capacitive shield 50, and will as a consequence provide a corresponding increase in torch efficiency.

Figure 9:
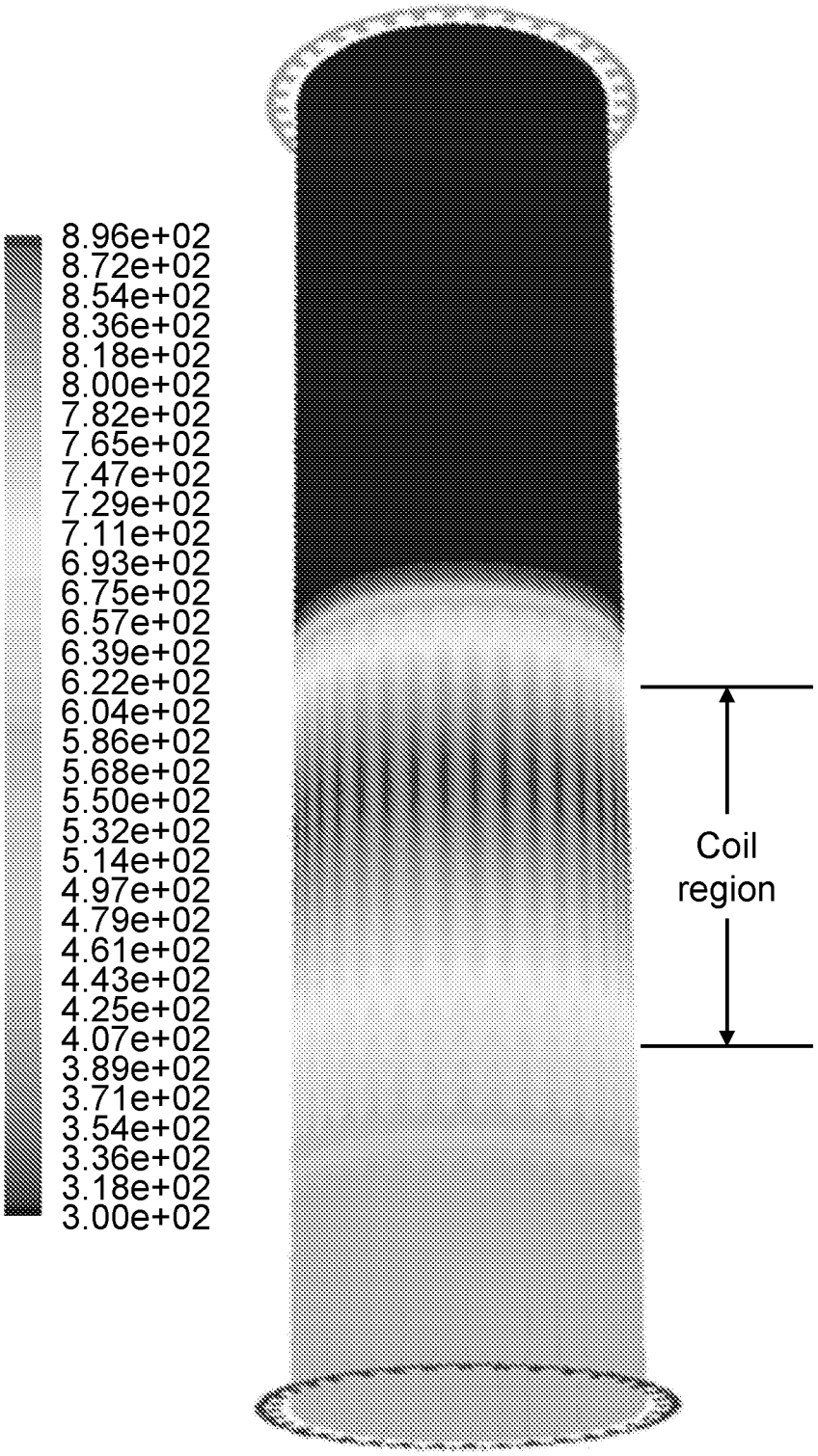
FIG. 9 is a three-dimensional representation of the temperature field in the wall of the plasma confinement tube of FIGS. 6 and 7 as obtained by mathematical modeling of the flow, temperature and concentration fields into the plasma torch and the wall of the plasma confinement tube under typical operating conditions.
Figure 10:
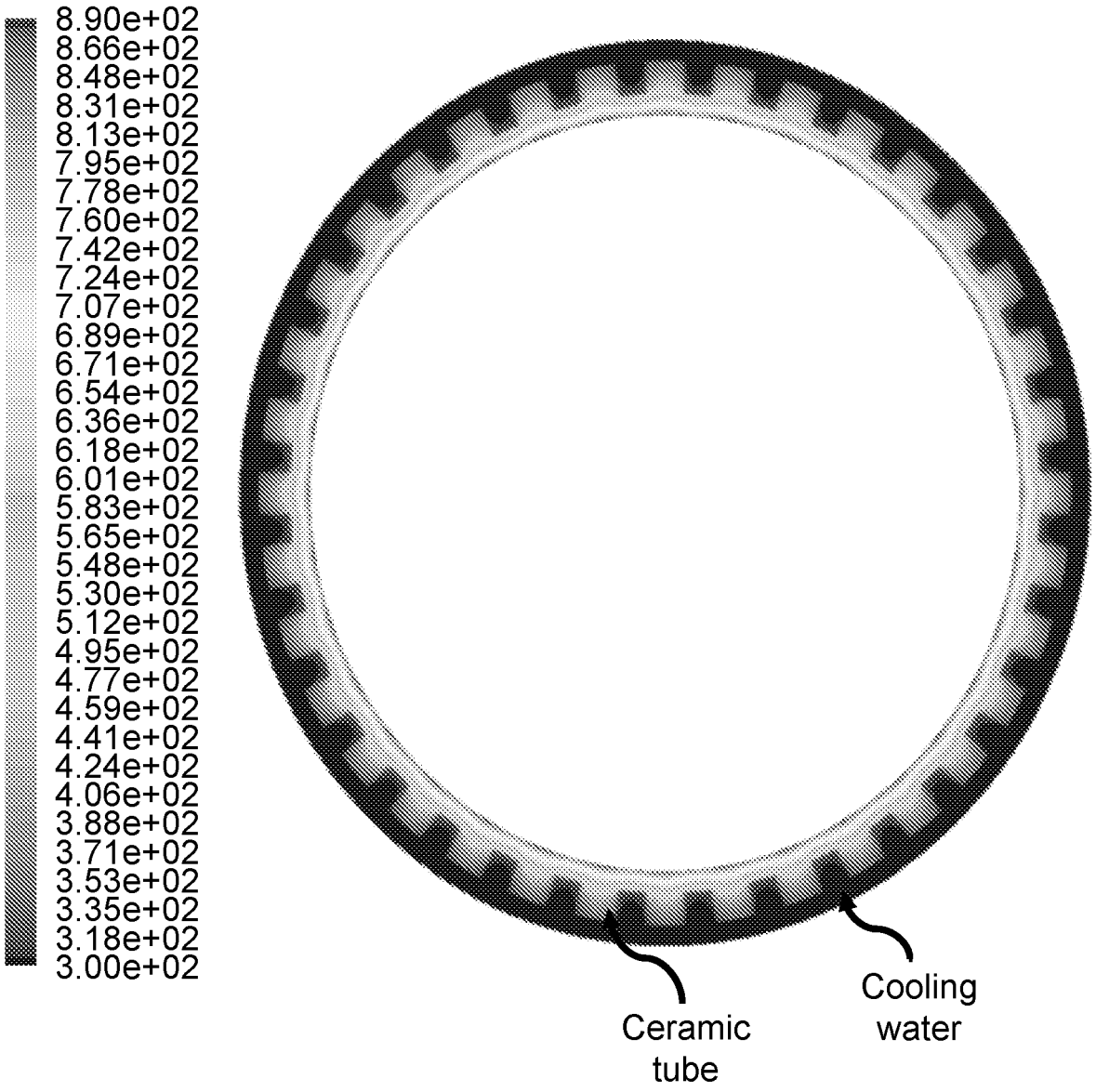
FIG. 10 is a sectional view of the temperature field in the wall of the plasma confinement tube at the center of the grooved section of that tube under the same operating conditions as those of FIG. 9.

The axial grooves 510 reduce the thickness of the wall of the plasma confinement tube 26 and extend the heat transfer surface area to improve the heat exchange between the inner surface of the axial grooves 510 and the cooling fluid flowing at high velocity through the annular chamber 45. More specifically, since the wall thickness of the plasma confinement tube 26 is thinner at the bottom of the axial grooves 510 compared to the wall thickness between the axial grooves 510, the heat exchange between the surface at the bottom of the grooves 510 and the cooling fluid is higher resulting in an increase of the transfer of heat from the plasma confinement tube 26 to the high velocity cooling fluid. The corresponding temperature field pattern in the plasma confinement tube is illustrated in FIGS. 9 and 10.

The axial grooves 510 machined into the outer surface of the plasma confinement tube 26 also provide a better insulation of the film of conductive material forming the axial strips 51' of the capacitive shield 50 by allowing a deeper penetration of the cooling fluid into the wall of the plasma confinement tube 26.

As the material of the plasma confinement tube is characterized by a high thermal conductivity, the high velocity of the cooling fluid flowing through the thin annular chamber 45 and, therefore, within the axial grooves 510 machined into the outer surface of the plasma confinement tube 26 provides for a high heat transfer coefficient. This intense and efficient cooling of the outer surface of the plasma confinement tube 26 enables production of plasma at much higher power/energy densities at lower gas flow rates. This also causes higher specific enthalpy levels of the gases at the exit of the plasma torch.

To fulfill the above functions, the individual grooves 510 in the outer surface of the plasma confinement tube 56 have a width that can vary between 1 and 10 mm, and a depth that can vary between 1 to 2 mm but not exceeding the overall thickness of the plasma confinement tube 26

According to another possible configuration, the film of conductive material of the capacitive shield 50, segmented or not, is applied to, for example deposited on the inner surface of the torch body 12 surrounding the plasma confinement tube 26 and in which the induction coil 14 is embedded. Again, axial grooves can be machined in the inner surface of the tubular torch body 12 between the axial strips of the film of conductive material in the same manner as on the outer surface of the plasma confinement tube 26 as described hereinabove. In this configuration, the film of conductive material of the capacitive shield 50 equally benefits from the cooling effect provided by the torch cooling liquid flowing in the annular chamber 45 to ensure thermal protection and mechanical and electrical integrity of the capacitive shield 50. Again, means may be provided for maintaining the capacitive shield 50 at a floating electric potential for plasma ignition beyond which means are provided for connecting the capacitive shield 50 to the ground for draining any capacitive potential developed on the surface of its film.

A function of the thin film capacitive shield 50 is to prevent stray arcing between the plasma and metallic components in the plasma torch, its exit nozzle and/or a reactor device on which the plasma torch is mounted. The capacitive shield 50 also enables introduction of multiple powder injection probes 42 in the torch inner cavity 13 as shown in FIGS. 3 and 4 to better disperse powder material into the plasma discharge.

Figure 1:
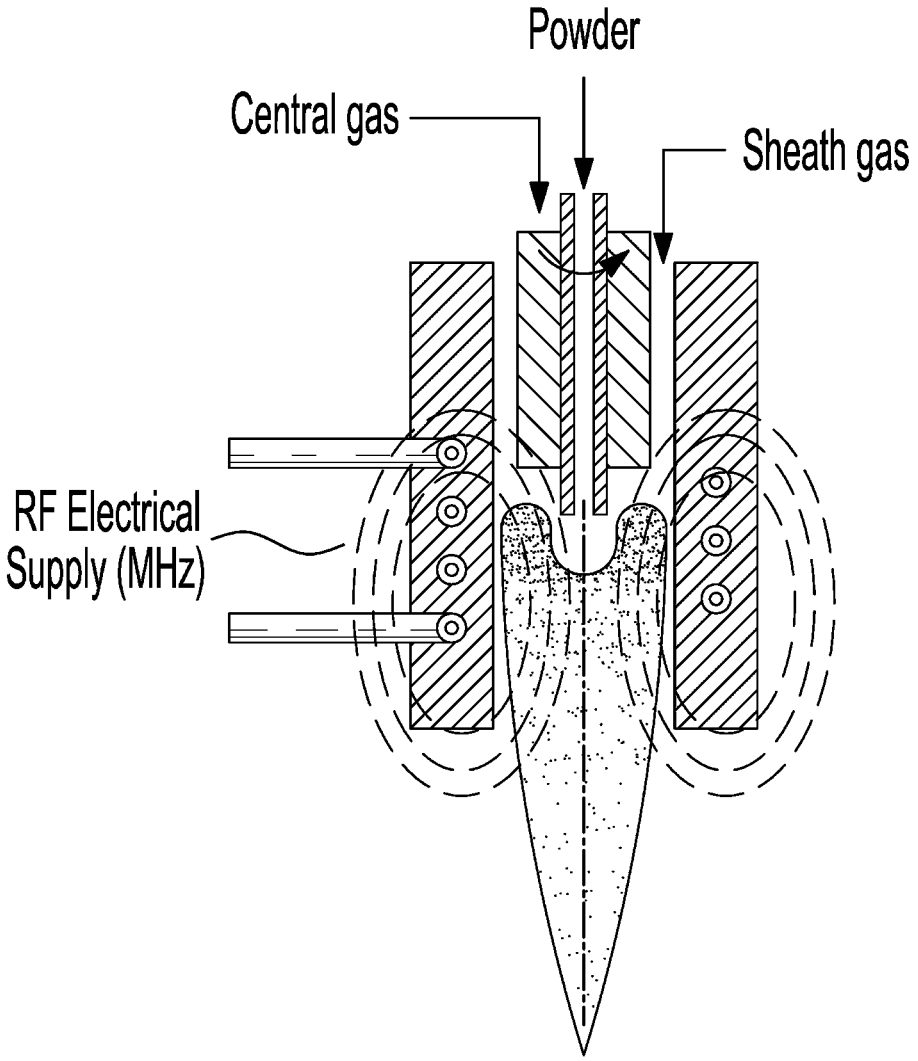
FIG. 1 is a schematic representation of an induction plasma torch.
Figure 2:
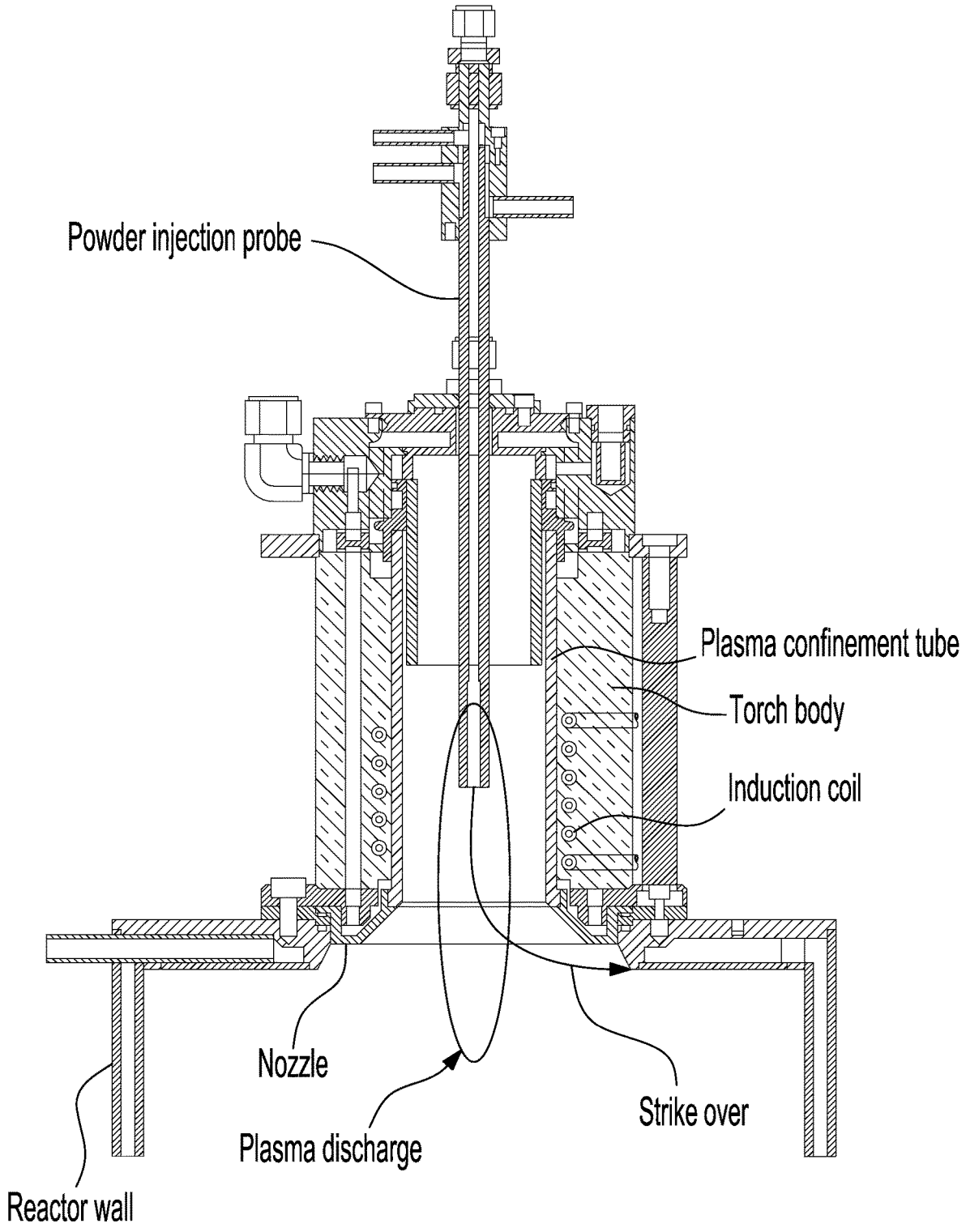
FIG. 2 is a schematic representation of an induction plasma torch mounted on the top of a reactor showing arcing between the plasma and the exit nozzle of the torch and the body of the reactor.

For example, the thin film capacitive shield 50 prevents possible arcing between the induction coil 14 and the powder injection probes 42 which can then be placed considerably closer to the inner wall of the plasma confinement tube 26, in comparison with the case when the probe is located centrally and coaxially in the torch as shown in FIG. 2.

The induction coil 14 being completely embedded in the material of the torch body 12, the spacing between the induction coil 14 and the plasma confinement tube 26 can be accurately controlled to improve the energy coupling efficiency between the induction coil 14 and the plasma. This also enables accurate control of the thickness of the annular chamber 45, without any interference caused by the induction coil 14, which control is obtained by machining to low tolerance the inner surface of the torch body 12 and the outer surface of the plasma confinement tube 26.

The quality of the plasma confinement tube 26 is closely related to the requirements of high thermal conductivity, high electrical resistivity and high thermal shock resistance. The present disclosure is not limited to the use of ceramic material but also encompasses the use of other materials either pure or composite provided that they satisfy the above, stringent requirements. For example, boron nitride, aluminum nitride or alumina composites constitute possible alternatives.

The small thickness (about 1 mm) of the annular chamber 45 plays a role in increasing the velocity of the cooling fluid through the thin annular chamber 45 and, therefore, over the outer surface of the plasma confinement tube 26 or the inner surface of the tubular torch body and accordingly to reach a high thermal transfer coefficient. More specifically, the quality of the cooling fluid and its velocity over the outer surface of the plasma confinement tube 26 are selected to carry out efficient cooling of this tube 26 and protection thereof against the high thermal fluxes to which it is exposed by the plasma.

Although the above description has described non-restrictive illustrative embodiments, these embodiments can be modified within the scope of the appended claims without departing from the spirit and nature of the present disclosure.

What is claimed is:

1. An induction plasma torch comprising:

a tubular torch body having an inner surface;

a plasma confinement tube having an outer surface and disposed inside the tubular torch body coaxial with said tubular torch body with an annular chamber formed between the inner surface of the tubular torch body and the outer surface of the plasma confinement tube;

a gas distributor head disposed at one end of the plasma confinement tube and structured to supply at least one gaseous substance into the plasma confinement tube;

an inductive coupling member outside the inner surface of the tubular torch body for applying energy to the gaseous substance to produce and sustain plasma in the plasma confinement tube;

a conductive capacitive shield applied to the inner surface of the tubular torch body, wherein the capacitive shield is segmented into axial strips, the axial strips are interconnected at one end, and the capacitive shield is in direct contact with the inner surface of the tubular torch body; and axial grooves entirely formed within a material of the tubular torch body through the inner surface of the tubular torch body, the axial grooves being interposed between the axial strips.

2. An induction plasma torch as defined in claim 1, wherein the capacitive shield is made of metallic material.

3. An induction plasma torch as defined in claim 1, wherein the plasma confinement tube is made of pure or composite ceramic material.

4. An induction plasma torch as defined in claim 1, wherein the annular chamber between the outer surface of the plasma confinement tube and the inner surface of the tubular torch body conducts a flow of cooling fluid for cooling both the capacitive shield and the plasma confinement tube.

5. An induction plasma torch as defined in claim 4, wherein the annular chamber has a thickness of about 1 mm.

6. An induction plasma torch as defined in claim 1, wherein the capacitive shield is connected to ground in order to drain any capacitive potential developed on the capacitive shield when the plasma has been ignited and is sustained.

7. An induction plasma torch comprising:

a tubular torch body having an inner surface;

a plasma confinement tube having an outer surface and disposed inside the tubular torch body coaxial with said tubular torch body with an annular chamber formed between the inner surface of the tubular torch body and the outer surface of the plasma confinement tube;

a gas distributor head disposed at one end of the plasma confinement tube and structured to supply at least one gaseous substance into the plasma confinement tube;

an inductive coupling member embedded within the tubular torch body for applying energy to the gaseous substance to produce and sustain plasma in the plasma confinement tube;

an electrically conductive capacitive shield applied to the inner surface of the tubular torch body, wherein the capacitive shield is segmented into axial strips, the axial strips are interconnected at one end, and the capacitive shield is in direct contact with the inner surface of the tubular torch body; and axial grooves entirely formed within a material of the tubular torch body through the inner surface of the tubular torch body, the axial grooves being interposed between the axial strips.

8. An induction plasma torch as defined in claim 7, wherein one of the axial grooves is interposed between each pair of laterally adjacent axial strips.

9. An induction plasma torch as defined in claim 7, wherein the grooves define a surface free from the capacitive shield.

10. An induction plasma torch as defined in claim 7, wherein the grooves have a width of 1 to 10 mm and a depth of 1 to 2 mm.

11. An induction plasma torch as defined in claim 7, wherein the capacitive shield is made of metallic material.

12. An induction plasma torch as defined in claim 7, wherein the plasma confinement tube is made of pure or composite ceramic material.

13. An induction plasma torch as defined in claim 7, An induction plasma torch as defined in claim 1, wherein the annular chamber between the outer surface of the plasma confinement tube and the inner surface of the tubular torch body conducts a flow of cooling fluid for cooling both the capacitive shield and the plasma confinement tube.

14. An induction plasma torch as defined in claim 13, wherein the annular chamber has a thickness of about 1 mm.

15. An induction plasma torch as defined in claim 7, wherein the capacitive shield is connected to ground in order to drain any capacitive potential developed on the capacitive shield when the plasma has been ignited and is sustained.

16. A tubular torch body for use in an induction plasma torch, the tubular torch body defining a geometrical axis and an inner surface, and comprising:

an inductive coupling member outside the inner surface of the tubular torch body;

a conductive capacitive shield applied to the inner surface of the tubular torch body, wherein the capacitive shield is segmented into axial strips, the axial strips are interconnected at one end, and the capacitive shield is in direct contact with the inner surface of the tubular torch body; and axial grooves entirely formed within a material of the tubular torch body through the inner surface of the tubular torch body, the axial grooves being interposed between the axial strips.

17. A tubular torch body for use in an induction plasma torch, the tubular torch body comprising an inductive coupling member embedded therein, defining a geometrical axis and an inner surface, and comprising:

a conductive capacitive shield applied to the inner surface of the tubular torch body, wherein the capacitive shield is segmented into axial strips, the axial strips are interconnected at one end, and the capacitive shield is in direct contact with the inner surface of the tubular torch body; and axial grooves entirely formed within a material of the tubular torch body through the inner surface of the tubular torch body, the axial grooves being interposed between the axial strips.

18. A tubular torch body as defined in claim 17, wherein one of the axial grooves is interposed between each pair of laterally adjacent axial strips.

19. A tubular torch body as defined in claim 17, wherein the grooves define a surface free from the capacitive shield.

20. A tubular torch body as defined in claim 17, wherein the grooves have a width of 1 to 10 mm and a depth of 1 to 2 mm.

* * * * *